US005441670A

United States Patent [19]

Shimamune et al.

[11] Patent Number: 5,441,670

[45] Date of Patent: Aug. 15, 1995

[54] PROCESS FOR PRODUCING AN ELECTRICALLY CONDUCTIVE MIXED OXIDE OF TITANIUM AND TANTALUM OR NIOBIUM

[75] Inventors: Takayuki Shimamune; Yasuo Nakajima, both of Tokyo, Japan

[73] Assignee: Permelec Electrode Ltd., Kanagawa, Japan

[21] Appl. No.: 121,258

[22] Filed: Sep. 15, 1993

Related U.S. Application Data

[62] Division of Ser. No. 992,053, Dec. 17, 1992, abandoned.

[30] Foreign Application Priority Data

Dec. 18, 1991 [JP] Japan ..... 3-354578

[51] Int. Cl.[6] ..... H01B 1/16

[52] U.S. Cl. ..... 252/520; 252/512; 501/134; 419/19; 432/13

[58] Field of Search ..... 419/19, 1, 45; 432/13; 252/512, 520; 501/134

[56] References Cited

U.S. PATENT DOCUMENTS 3,033,907 5/1962 Rue ..... 501/134

5,028,568 7/1991 Andersen et al. ..... 501/12

FOREIGN PATENT DOCUMENTS 0052468 5/1982 European Pat. Off. ..... 252/500

*Primary Examiner*—Kathryn Gorgos

*Attorney, Agent, or Firm*—Sughrue, Mion, Zinn, Macpeak & Seas

[57] ABSTRACT

A process for producing an electrically conductive mixed oxide comprises sintering a power mixture comprising from 30 to 98% by weight of titanium oxide, in terms of the amount of titanium based on the total amount of all the metallic elements, from 1 to 10% by weight of at least one of titanium metal and titanium hydride, in terms of the amount of titanium based on the total amount of all the metallic elements, and from 1 to 60% by weight of at least one of tantalum oxide and niobium oxide, in terms of the amount of tantalum, niobium, or tantalum and niobium based on the total amount of all of the metallic elements. The process provides a sintered solid comprising titanium, at least one of tantalum and niobium, and a stoichiometrically deficient amount of oxygen. The content of titanium in the sintered solid is from 40 to 99% by weight and the content of tantalum, niobium, or tantalum and niobium in the sintered solid is from 1 to 60% by weight, respectively, based on the total amount of all of the metallic elements in the mixed oxide.

4 Claims, No Drawings

PROCESS FOR PRODUCING AN ELECTRICALLY CONDUCTIVE MIXED OXIDE OF TITANIUM AND TANTALUM OR NIOBIUM

This is a divisional of application Ser. No. 07,992,053 filed Dec. 17, 1992, now abandoned.

FIELD OF THE INVENTION

The present invention relates to a mixed oxide having corrosion resistance and electrical conductivity and to a process for producing the mixed oxide. More particularly, this invention relates to a corrosion-resistant and electrically-conductive mixed oxide which can be utilized as an electrode material usable for either an anode or a cathode, and to a process for producing the mixed oxide.

BACKGROUND OF THE INVENTION

Industrial electrolysis, particularly electrolysis of mainly inorganic acids, is being conducted in an extremely wide range of fields such as electrolytic refining of metals, electroplating, electrolytic syntheses of organic substances and inorganic substances, etc. Although lead or lead alloy electrodes, platinum-plated titanium electrodes, carbon electrodes, and the like have been proposed as electrodes, especially anodes, for use in such electrolytic processes, each of these electrodes has certain drawbacks and, hence, none of them have come into practical use in a wide range of electrolytic applications. For example, lead electrodes, which have on the surface thereof a layer of lead dioxide that is relatively stable and has good electrical conductivity, have drawbacks in that even this lead dioxide dissolves away under conventional electrolytic conditions at a rate of several mg/AH and in that the electrode shows a large overvoltage. A further problem with lead electrodes is that when these electrodes are placed into a cathodically polarized state, the function of the electrodes is impaired because lead metal is more stable than lead dioxide and, hence, the lead dioxide is reduced to lead. Platinum-plated titanium electrodes have a short life for their high price. Further, carbon electrodes have drawbacks in that where the anodic reaction is an oxygen-evolving reaction, the carbon electrodes react with the evolved oxygen and consume themselves as carbon dioxide. Carbon electrodes also have poor electrical conductivity.

Other conventional electrically conductive oxides for use in electrolytic electrodes include manganese dioxide and tin dioxide. However, these two oxides are not being used on an industrial scale because the former oxide has an extremely short anode life and the latter oxide has insufficient electrical conductivity.

In order to avoid these drawbacks of conventional electrodes, a dimensionally stable electrode (DSE) has been proposed and developed and is being used extensively.

The DSE functions as a long-life electrode having exceptionally good chemical stability so long as it employs a valve metal such as titanium as the substrate and is used as an anode, because the surface of the valve metal substrate is passivated. However, when the DSE is used as a cathode and undergoes a cathodic polarization, the substrate is converted into a hydride through reaction with evolved hydrogen and, as a result, the substrate itself becomes brittle or the surface coating peels off due to corrosion of the substrate, leading to a considerably shortened electrode life. This is a serious drawback when the DSE is used in electrolytic processes in which the current flow is reversed.

In addition, the DSE has another problem in that if it is used in an electrolyte solution containing fluorine or fluoride ions in even a slight amount, the valve metal substrate (typically titanium or a titanium alloy) suffers corrosion which shortens the electrode life considerably even when the electrode is used as an anode. For example, if the DSE is used in an electrolyte solution containing fluorine in an amount as slight as from about 3 to 5 ppm, the electrode life is, at the most, one-hundredth the ordinary life of the electrode. Thus, this problem constitutes a serious obstacle to possible applications of the DSE to various electrolytic fields other than soda-producing electrolysis for which the electrode can be used completely satisfactorily.

As a means to overcome the problems described above, it has been proposed to use electrically conductive sintered solids (ceramics) as electrodes. For example, magnetite ($Fe_3O_4$), sintered solids having a ferrite magnetite structure, sintered solids having a maghemite structure, and the like are actually being used for electrodes. However, electrodes produced from these materials having a drawback in that although they are relatively stable in neutral or alkaline solutions, the conditions under which they can be used as electrodes in acidic solutions are limited.

In recent years, attention has focused especially on a magneli-phase titanium oxide electrode as an electrode having resistance to fluorine ions. This electrode material is constituted by an electrically conductive titanium oxide which is rather similar to the substances represented by $TiO_{2-x}$, so-called suboxides such as $Ti_4O_7$. It is known that this titanium oxide in such a stabilized state is never reduced into titanium even when cathodically polarized and suffers almost no corrosion even when anodically polarized. Further, even when the titanium oxide is used in an electrolyte solution containing fluorine ions or a fluoride, it suffers almost no corrosion if the content of such a corrosive substance is 1,000 ppm or less. However, this titanium oxide has slightly insufficient electrical conductivity and, due to this, the quantity of electricity applicable to the titanium oxide is limited. Except for this, the electrically conductive titanium oxide as a material for an electrode or electrode substrate shows attractive properties.

However, since the above-described titanium oxide itself has almost no catalytic activity, the titanium oxide is usually covered with iridium oxide or the like before being used as an electrode. This electrode has a drawback in that the current density limit is low due to insufficient electrical conductivity. Also, when the electrode is used in an acidic solution to conduct an oxygen-evolving reaction on the electrode surface, the titanium oxide of the substrate at the interface with the iridium oxide is converted from $Ti_4O_7$ to $TiO_2$ and is thus passivated and, as a result, application of electric current to the electrode becomes impossible.

SUMMARY OF THE INVENTION

An object of the present invention is to provide an electrically conductive mixed oxide usable for producing an electrode or electrode substrate which, even when used in a cathodically polarized state in electrolytic processes involving a reversal of current flow or when used in electrolyte solutions containing a corrosive substance such as fluorine, undergoes almost no corrosion or other undesirable changes and can be used over a long period of time under stable electrolytic conditions, thereby overcoming the above-described drawbacks of conventional electrically conductive materials, particularly the drawbacks associated with titanium oxide-type materials for use in producing ceramic electrodes.

Another object of the present invention is to provide a process for producing the electrically conductive mixed oxide described above.

The electrically conductive mixed oxide of the present invention is a sintered solid comprising titanium, oxygen, and at least one of tantalum and niobium, and having a non-stoichiometric composition in which tetravalent titanium and at least one of pentavalent tantalum and niobium have a deficiency of oxygen, the content of titanium in the sintered solid being from 40 to 99% by weight and the content of tantalum, niobium, or tantalum and niobium in the sintered solid being from 1 to 60% by weight, respectively, based on the total amount of all the metallic elements in the mixed oxide.

The process of the present invention for producing the mixed oxide described above comprises sintering a powder mixture prepared by adding titanium metal, titanium hydride, or both to a mixture of titanium oxide and at least one of tantalum oxide and niobium oxide to prepare the mixed oxide as a sintered body having a non-stoichiometric composition.

DETAILED DESCRIPTION OF THE INVENTION

As described above, when a titanium oxide sintered solid having a crystalline structure such as that of the magneli phase is covered with an electrode active material layer and used as an electrode, the titanium oxide in most cases converts to stable titanium dioxide due to elimination of lattice defects and, as a result, the substrate loses its electrical conductivity and application of electric current to the electrode becomes impossible.

The electrically conductive mixed oxide in accordance with the present invention comprises titanium oxide having incorporated therein, at least one of tantalum and niobium having a valence other than tetravalence. Due to this specific composition and due to partial reduction which the mixed oxide is caused to undergo, lattice defects are created in the mixed oxide by replacing titanium atoms in, for example, a rutile-type crystal lattice with tantalum or niobium atoms. As a result, the oxide can be a semi-conductive mixed oxide having the property of transmitting both ions and electrons. Therefore, the mixed oxide provided by the present invention can be used especially as a material for electrodes which, even when used continuously over a long period of time, does not fall into such a state that application of electric current is impossible.

Accordingly, the addition of at least one of tantalum and niobium to titanium oxide basically having a non-stoichiometric composition, in the electrically conductive mixed oxide of the present invention, is intended to create lattice defects and ensure electrical conductivity, by the addition of tantalum and/or niobium and by allowing at least part of the tantalum and/or niobium to be added, as atoms having a valence of four as different from the ordinary valence, into the crystal lattice of the titanium oxide to provide a solid solution. Therefore, where this electrically conductive mixed oxide is, for example, used to produce an electrode and electrolysis is continuously performed using this electrode, the electrical conductivity of the mixed oxide is ensured even if the non-stoichiometric composition ($RO_{2-x}$ wherein R is a metallic element and $0<x<1$) partly changes into the stoichiometric composition ($RO_2$). Moreover, tantalum and niobium are characterized as being superior to titanium in corrosion resistance in a corrosive environment containing fluorine ions or the like and, hence, enable the mixed oxide of the present invention to have higher chemical stability and better electrical conductivity than conductive materials consisting of titanium oxide only.

Usually, electrically conductive titanium is obtained by sintering titanium oxide ($TiO_2$) in a reducing atmosphere. This sintering method, however, is disadvantageous in that it is difficult to fix the sintering conditions and, in order to obtain satisfactory electrical conductivity, trial sintering should be conducted many times under different conditions. In particular, the sintering method has a drawback in that sintering in an oxidizing atmosphere cannot give electrically conductive titanium. Therefore, in the process of the present invention, it is desirable that, for obtaining electrically conductive titanium oxide, a combination of titanium oxide and titanium metal be used as part of the powder mixture to be sintered. According to the process of the present invention, this titanium oxide-titanium metal mixture is mixed with at least one of tantalum oxide and niobium oxide and the resulting powder mixture is sintered to obtain an electrically-conductive mixed oxide. In preparing the powder mixture, all or part of the titanium metal may be replaced with titanium hydride. Titanium hydride has the advantages of being more easily available in a powder form and of being more easily handled than titanium metal. Titanium hydride also has the advantage of readily turning into titanium metal or titanium oxide upon heating for sintering.

This process described in the preceding paragraph has made sintering in an oxidizing atmosphere possible; such sintering has in the past been impossible to carry out with powder mixtures containing no titanium metal. Further, according to the process of the present invention, the desired electrically conductive mixed oxide can be obtained even through sintering in an inert atmosphere or in a vacuum.

The amount of titanium metal added to the powder mixture to be sintered is preferably from 1 to 10% by weight based on the total weight of all metallic elements in the powder mixture. The especially preferred range of the amount of titanium metal added is from 5 to 9% by weight, although it varies depending on the sintering atmosphere and conditions. If the amount of titanium metal added exceeds 10% by weight, problems may occur, depending on the amount of tantalum and niobium. For example, it may be difficult or impossible to make the mixture uniform and the titanium metal only may oxidize first upon heating in an oxidizing atmosphere.

Where sintering of the powder mixture is conducted in an oxidizing atmosphere, the amount of titanium metal added to the powder mixture preferably is relatively small, specifically from 2 to 6% by weight. Higher percentages of titanium metal can be used when sintering in a vacuum or inert atmosphere because sintering in a vacuum or inert atmosphere is free from the problem that titanium metal only is oxidized first and because higher temperatures necessarily bring about a weakly reducing atmosphere.

As described above, at least one of tantalum oxide and niobium oxide is added to the powder mixture to be sintered. The tantalum and niobium impart semi-conductivity and corrosion resistance to the sintered solid obtained. The amount of the tantalum and niobium added may be 1 to 30% by weight based on the total weight of all metallic elements contained in the powder mixture, such an amount being sufficient from the standpoint of semi-conductivity only. However, from a corrosion resistance standpoint, tantalum and/or niobium may be added in an amount up to 60% by weight. Through sintering, at least part of the tantalum and niobium atoms are incorporated into the crystal lattice of titanium oxide to form a semi-conductive oxide. Although the remainder of the tantalum and niobium atoms may be present in the resulting sintered solid as an independent phase of tantalum oxide ($Ta_2O_5$) or niobium oxide ($Nb_2O_5$), such independent phases cause almost no decrease in electrical conductivity. However, if the amount of tantalum oxide and niobium oxide added to the powder mixture exceeds 60% by weight in terms of the amount of tantalum and niobium based on the total weight of all metallic elements, the electrical conductivity of the sintered solid obtained is adversely affected. The tantalum oxide and niobium oxide come to have slight electrical conductivity through sintering, probably because of replacement of tantalum and niobium with titanium. However, since the electrical conductivity of the tantalum oxide and niobium oxide is too low, the presence of large amounts of these oxides results in a decrease in the electrical conductivity of the conductive sintered solid as a whole. Therefore, the amount of titanium oxide added to the powder mixture to be sintered should be from 30 to 98% by weight in terms of the amount of titanium, exclusive of the titanium metal and the titanium contained in the titanium hydride, based on the total weight of all metallic elements.

Suitable raw materials for the titanium oxide used for preparing the powder mixture include a natural rutile ore from which impurities have been removed and synthetic rutile. As the titanium metal, a titanium sponge is preferably used because it is inexpensive and easily pulverizable. Although a mixture of tantalum oxide and niobium oxide may be prepared by mixing a tantalum oxide powder and a niobium oxide powder, it is preferable to use an inexpensive, purified tantalite or columbite ore which contains both oxides. Since tantalum and niobium have similar chemical properties, tantalum oxide-niobium oxide mixtures having slightly different tantalum/niobium ratios can be used without the necessity of taking such a compositional difference into account.

Mixing methods for the titanium oxide and other ingredients for preparing the powder mixture to be sintered are not particularly limited. It is, however, desirable to employ a wet mixing technique because the ingredients include titanium metal.

Shaping methods for the powder mixture are not particularly limited so long as the powder mixture is subjected to sintering. It is, however, desirable that no binder be added to the powder mixture, from the standpoint of obtaining a more uniform sintered solid. Besides being conducted in a furnace, sintering of the powder mixture may be performed by flame-spraying the mixture onto, for example, an electrode substrate where the electrically conductive mixed oxide of the present invention is used as an electrode material.

The sintering of the powder mixture is conducted in an atmosphere which may be any of an oxidizing atmosphere, e.g., air, an inert atmosphere, e.g., argon, and a vacuum. In the case of using a Tammann furnace, carbon furnace, or the like in which sintering is conducted in a reducing atmosphere without introducing a gas thereinto, it is preferred that the powder mixture to be sintered have a slightly low titanium metal content. The sintering temperature varies depending on the composition of the powder mixture, but it preferably is from 700° to 1,500° C. more preferably from 1,000° to 1,300° C. If sintering is conducted at a temperature higher than 1,500° C., there is the possibility, depending on the composition, that the growth of tantalum oxide and niobium oxide as independent phases might proceed ideally, resulting in impaired electrical conductivity. If the sintering temperature is below 700° C., there are cases where the sintering does not proceed sufficiently, giving a sintered solid containing still coarse particles, and there are cases below 700° C. where the sintering proceeds only when a sintering aid is added.

Thus, a sintered solid can be obtained by conducting sintering once. By pulverizing the thus-obtained sintered solid and subjecting the resulting powder to sintering again, a sintered solid having a more uniform composition can be obtained.

The electrically conductive mixed oxide thus produced possesses both electrical conductivity and corrosion resistance, which usually are incompatible with each other, and is useful especially as a material for electrolytic electrodes. Electrodes obtained using the electrically conductive mixed oxide are, of course, usable in conventional electrolytic processes. Further, even when such electrodes are used in a cathodically polarized state in electrolysis involving a reversal of current flow or used in electrolyte solutions containing a corrosive substance such as fluorine or a fluorine-containing compound, the electrolytic processes can be continued stably over a long period of time. Hence, the electrically conductive mixed oxide of the present invention is especially useful in such applications.

The present invention will be explained below in more detail with reference to Examples illustrating production and application methods for electrically conductive mixed oxides according to the present invention and Comparative Examples. However, the present invention should not be construed as being limited to the Examples. In each of the examples, the amount of each of the ingredients, e.g., metal oxides, used as raw materials for a powder mixture to be sintered is given in terms of the amount of the metal and the composition of the powder mixture is shown in terms of the weight ratio between such metal amounts. Although the composition of each sintered solid obtained is not shown, the weight ratio between the amounts of metals in the sintered solid is substantially the same as that for the powder mixture used, because the amount of each metal does not decrease during the process for producing the sintered solid.

EXAMPLE 1

A natural rutile ore was pulverized into a 350 mesh powder, which was then boiled in boiling 20% hydrochloric acid for 1 hour to remove any hydrochloric acid-soluble component of the rutile ore. The resulting rutile ore powder was washed with water and dried, and 87 g of the dry powder, in terms of the amount of titanium metal, was then weighed out. Thereto were added 6 g of titanium metal in the form of sponge particles and 7 g of a tantalum oxide powder in terms of the amount of tantalum metal. The mixed powders were subjected to wet pulverization and mixing in ethyl alcohol for 10 hours by means of an automatic mortar. Subsequently, the resulting powder mixture was compacted with application of a pressure of 1 t/cm$^2$ to prepare a pellet having a diameter of 4 cm.

This pellet was placed in a muffle furnace and sintered at 1,300° C. for 2 hours. After cooling, the pellet was taken out. The thus-obtained sintered solid was of a grayish white color and had been sufficiently hardened. The crystalline structure of this sintered solid was examined by X-ray diffractometry. As a result, a diffraction line assigned to $Ta_2O_5$ present in a minute amount in the sintered solid and a slightly widened diffraction line assigned to a rutile structure ($RO_2$ or $Ti_4O_7$) were observed.

The resistivity of the sintered solid was measured by the four-point method and was found to be $1.5\times10^2\Omega$cm.

The sintered solid obtained above was cut into a thickness of 1 mm. This sintered plate was covered on one side with iridium oxide by a pyrolytic method. Thereafter, a copper plate as a feeder plate was bonded to the other side of the sintered plate by means of a silver paste. Using this structure as an anode and using an electrolyte solution prepared by adding hydrofluoric acid to 4N sulfuric acid in an amount so as to result in a fluorine ion concentration of 100 ppm, an electrolysis test was conducted under conditions of an electrolyte solution temperature of 80° C. and a current density of 100 A/dm$^2$ (oxygen was evolved on the anode by water electrolysis). As a result, even after 100 hours electrolysis, the anode did not suffer any change and the electrolysis could be further continued.

The composition of the raw powder mixture (the relative amounts of metals) and the crystalline phase, resistivity, and corrosion resistance of the sintered solid are shown in Table 1.

EXAMPLES 2 TO 9

Sintered solids were obtained in the same manner as in Example 1 except that the amounts of titanium oxide, titanium metal (titanium hydride was used in place of titanium metal in Examples 2 and 6), tantalum oxide, and niobium oxide (which was used in Examples 7 and 8 only) were changed as shown in Table 1. These sintered solids were examined for crystalline phase, resistivity, and corrosion resistance. The results obtained are shown in Table 1.

Table 1 shows that by regulating the amounts of titanium oxide, titanium metal or titanium hydride, and tantalum oxide and/or niobium oxide in the respective ranges specified hereinabove, sintered solids having low resistivity and excellent corrosion resistance can be obtained.

TABLE 1

| | $TiO_2$ | Ti metal | $Ta_2O_5$ | $Nb_2O_5$ | Crystalline phase | Resistivity ($\times 10^2$ Ωcm) | Corrosion resistance |
|---|---|---|---|---|---|---|---|
| | wt % (metal amount) | | | | | | |
| Example | | | | | | | |
| 1 | 87 | 6 | 7 | 0 | rutile, $Ta_2O_5$ | 1.5 | good |
| 2 | 38 | 3(*) | 59 | 0 | " | 6.0 | " |
| 3 | 43 | 4 | 53 | 0 | " | 4.5 | " |
| 4 | 53 | 5 | 42 | 0 | " | 4.2 | " |
| 5 | 87 | 2 | 11 | 0 | rutile | 1.8 | " |
| 6 | 85 | 8(*) | 7 | 0 | rutile | 1.2 | " |
| 7 | 89 | 2 | 0 | 9 | rutile, $Nb_2O_5$ | 2.4 | " |
| 8 | 87 | 8 | 4 | 1 | rutile | 1.4 | " |
| 9 | 93 | 1 | 6 | 0 | rutile | 4.0 | " |
| Comparative Example | | | | | | | |
| 1 | 94 | 6 | 0 | 0 | rutile | 8.0 | partly dissolved away |
| 2 | 30 | 5 | 65 | 0 | rutile, $Ta_2O_5$ | 8.2 | good |
| 3 | 73 | 15 | 12 | 0 | rutile, titanium | 1.2 | partly dissolved away |
| 4 | 75 | 23 | 2 | 0 | rutile, titanium | 1.2 | partly dissolved away |

Note:
(*) indicates use of titanium hydride in place of titanium metal.

COMPARATIVE EXAMPLE 1

A compacted-powder pellet having a diameter of 4 cm was prepared in the same manner as in Example 1 except that a tantalum oxide powder was not added and that the titanium oxide powder in an amount of 94 g in terms of the amount of titanium metal was mixed with 6 g of titanium metal in the form of sponge particles. This pellet was sintered under the same conditions as in Example 1, thereby obtaining a sintered solid which was of a grayish white color and had been sufficiently hardened. The crystalline structure of this sintered solid was examined by X-ray diffractometry. The results of this examination were the same as those for the sintered solid of Example 1 except that the diffraction line assigned to $Ta_2O_5$ was not observed. The resistivity of the sintered solid was measured by the four-point method and was found to be $8.3\times10^{-2}$ Ωcm, which is about 6 times the resistivity value for the sintered solid of Example 1. The results show that electrical conductivity is improved significantly by the addition of a proper amount of tantalum oxide.

Using the above-obtained sintered solid as an anode, an electrolysis test was performed under the same conditions as in Example 1. As a result, the coating of the anode peeled off in 80 hours. The evaluation results for this comparative sintered solid are shown in Table 1.

COMPARATIVE EXAMPLES 2 TO 4

Sintered solids were prepared in the same manner as in Comparative Example 1 except that the amounts of titanium oxide, titanium metal, and tantalum oxide were changed as shown in Table 1. These sintered solids were examined for crystalline phase, resistivity, and corrosion resistance. The results obtained are shown in Table 1.

Table 1 shows that electrical resistivity is reduced greatly by the addition of tantalum oxide or niobium oxide, provided that the degree of decrease in electrical resistivity is low when the amount of the oxide added is too large. This may be because when tantalum oxide or niobium oxide is added in a proper amount, the tantalum or niobium is incorporated into the crystal lattice of titanium oxide to form a solid solution having lattice defects thereby improving the property of transmitting ions and electrons, and because if tantalum oxide or niobium oxide is added in too large amount, part of the tantalum or niobium oxide remains unincorporated in the crystal lattice of titanium oxide and forms an independent phase thereby increasing electrical resistivity. It can also be seen that sintering of a powder mixture to which titanium metal has been added results in a sintered solid having a lower electrical resistivity than sintered solids obtained from powder mixtures to which titanium metal had not been added.

It can further be seen from Table 1 that the addition of tantalum oxide and/or niobium oxide serves to improve corrosion resistance, especially resistance to corrosion by fluorine ions, so that the electrodes of the Examples have better electrical conductivity and corrosion resistance than the electrode of Comparative Example 1. However, too large an amount of tantalum oxide and/or niobium oxide resulted in poor corrosion resistance and insufficient electrical conductivity probably because of formation of an independent phase of tantalum oxide or niobium oxide.

Table 1 furthermore shows that the addition of titanium metal or titanium hydride serves to lower electrical resistivity, but it is desirable that titanium metal and/or titanium hydride be added in an amount of 10% by weight or less because too large an addition amount of titanium metal and/or titanium hydride results in impaired corrosion resistance.

As described above, the electrically conductive mixed oxide of the present invention is a sintered solid comprising titanium, at least one of tantalum and niobium, and oxygen and having a non-stoichiometric composition in which tetravalent titanium and at least one of pentavalent tantalum and niobium have a deficiency of oxygen, the content of titanium in the sintered solid being from 40 to 99% by weight and the content of tantalum, niobium, or tantalum and niobium in the sintered solid being from 1 to 60% by weight, respectively, based on the total weight of all the metallic elements in the mixed oxide.

This mixed-oxide sintered solid has lattice defects formed by the incorporation of tantalum and/or niobium into the crystal lattice of titanium oxide, and these lattice defects impart the property of transmitting ions and electrons. Further, since tantalum and niobium are superior in corrosion resistance to titanium, the mixed oxide can possess both electrical conductivity and corrosion resistance, which usually are incompatible properties. The electrically conductive mixed oxide of this invention which has such useful properties can be used as a raw material in various applications. Particularly preferred uses of the electrically conductive mixed oxide are in electrolytic electrodes, especially those for use in the electrolysis of electrolyte solutions containing fluorine or a fluorine compound or in electrolysis involving a reversal of current flow, because the mixed oxide shows high resistance to corrosion by fluorine or a fluorine compound, cathodic polarization, etc.

However, since too large an addition amount of tantalum oxide and/or niobium oxide results in formation of an independent phase or phases of tantalum oxide, niobium oxide, or both, and hence, in impaired electrical conductivity, the amount of the tantalum oxide and/or niobium oxide added is from 1 to 60% by weight.

According to the process of the present invention for producing the electrically conductive mixed oxide, a powder mixture comprising titanium oxide and titanium metal in a total amount of from 40 to 99% by weight in terms of the amount of metallic titanium and tantalum oxide and/or niobium oxide in a total amount of from 1 to 60% by weight in terms of the total amount of metallic tantalum and niobium is sintered. The electrically conductive mixed oxide produced by this process has excellent properties as described above. Moreover, when the powder mixture contains both titanium oxide and titanium metal, it can be sufficiently sintered even in any sintering atmosphere to obtain a sintered solid constituted by strongly bonded fine particles.

While the invention has been described in detail and with reference to specific embodiments thereof, it will be apparent to one skilled in the art that various changes and modifications can be made therein without departing from the spirit and scope thereof.

What is claimed is:

1. A process for producing an electrically conductive mixed oxide which comprises sintering a powder mixture comprising from 30 and 98% by weight of titanium oxide, in terms of the amount of titanium based on the total amount of all the metallic elements, from 1 to 10% by weight of at least one of titanium metal and titanium hydride, in terms of the amount of titanium based on the total amount of all of the metallic elements, and from 1 to 60% by weight of at least one of tantalum oxide and niobium oxide, in terms of the amount of tantalum, niobium, or combination of tantalum and niobium based on the total amount of all the metallic elements, to thereby obtain a sintered solid comprising titanium, at least one of tantalum and niobium, and a stoichiometrically deficient amount of oxygen, the content of titanium in the sintered solid being from 40 to 99% by weight and the content of tantalum, niobium, or tantalum and niobium in the sintered solid being from 1 to 60% by weight, respectively, based on the total amount of all of the metallic elements in the mixed oxide.

2. The process of claim 1, wherein the powder mixture comprises from 5 to 9% by weight of titanium metal.

3. The process of claim 1, wherein the sintering temperature is from 700° to 1,500° C.

4. The process of claim 1, wherein the sintering temperature is from 1,000° to 1,300° C.

* * * * *